US005685212A

United States Patent [19]

Licata et al.

[11] Patent Number: 5,685,212

[45] Date of Patent: Nov. 11, 1997

[54] ROTATING PUNCH

[75] Inventors: John A. Licata, Greenville; Donald S. Wright, Rocky Mount; Edward J. Stanley, Greenville, all of N.C.

[73] Assignee: ILCO Unican Corp., Rocky Mount, N.C.

[21] Appl. No.: 284,240

[22] Filed: Aug. 2, 1994

[51] Int. Cl.[6] ..... B26D 7/06

[52] U.S. Cl. ..... 83/277; 83/522.15; 83/522.19; 83/522.21; 83/917; 83/278; 83/249; 83/206; 83/452; 83/464

[58] Field of Search ..... 83/412, 413, 414, 83/917, 522.18, 522.19, 559, 522.15, 522.21, 522.25, 451, 452, 459, 463, 464, 465, 466, 206, 249, 277, 278; 409/81, 82, 63

[56] References Cited

U.S. PATENT DOCUMENTS

| | | | |
|---|---|---|---|
| 387,251 | 9/1888 | Schneider | 83/522.19 |
| 1,408,166 | 2/1922 | Berry | 409/81 |
| 1,750,218 | 3/1930 | Falk | 409/81 |
| 1,886,641 | 11/1932 | Caron | 409/81 |
| 2,071,402 | 2/1937 | Hazelton | 83/522.19 |
| 2,183,193 | 12/1939 | Husson | 74/124 |
| 2,812,816 | 11/1957 | Hoffman | 164/50 |
| 3,083,635 | 4/1963 | O'Hare | 100/223 |
| 3,466,747 | 9/1969 | Patriquin et al. | 83/917 |
| 3,496,636 | 2/1970 | Lieptz | 30/131 |
| 3,722,341 | 3/1973 | Hungerford, Jr. et al. | 83/917 |
| 3,748,940 | 7/1973 | Muri | 83/414 |
| 3,981,214 | 9/1976 | Wich | 83/917 |
| 4,062,261 | 12/1977 | Stahl | 83/522.18 |
| 4,651,604 | 3/1987 | Almblad et al. | 83/917 |
| 4,993,291 | 2/1991 | Sopko | 83/39 |
| 5,142,958 | 9/1992 | Nordlin et al. | 83/559 |
| 5,165,315 | 11/1992 | Terada | 83/249 X |

*Primary Examiner*—Rinaldi I. Rada
*Assistant Examiner*—Boyer Ashley
*Attorney, Agent, or Firm*—Hill, Steadman & Simpson

[57] ABSTRACT

A key punch apparatus is provided for selectively removing notches of material from a key blank. The apparatus includes a punch and die subassembly which is rotatable between first and second positions. A carrier holds the key blank in an operative relation with the subassembly. An actuating handle is operatively coupled to the punch to cause an axial cutting stroke. Cutting a notch with the subassembly in the first position results in a notch having a first shape, while cutting a notch with the subassembly in the second position results in a notch having a second shape.

6 Claims, 4 Drawing Sheets

ROTATING PUNCH

BACKGROUND OF THE INVENTION

The present invention constitutes an improvement to a portable key punch apparatus as described in U.S. Pat. No. 3,748,940, issued to George Muri, which is incorporated herein by reference. That patent relates to a punch apparatus for removing notches of material from a key blank.

Locks openable with a key are generally known. Such locks have a number of tumblers therein, and the lock is openable by manipulating the tumblers with a key. Each lock has an associated key notched in a configuration corresponding to the positioning of the tumblers in the lock. A key of a desired configuration can be formed by cutting notches from a key blank. A known method of cutting such notches is with a punch and die.

Keys and locks are commonly provided with five, six, seven, or eight tumbler positions. Accordingly, notches are cut along the key blank at positions spaced to correspond with the required number of notches. The depth of the various notches in a particular key are desirably unique from other keys which correspond to different locks. Thus, for a key configuration having a certain number of notch positions, the notch depths must be varied. The depth of a notch is commonly referred to as its bite.

Notches can be cut of various shapes. Typically, notches are trapezoidal, but can also be V-shaped, square, etc. Also, a key can have notches of different shapes. Where in this case, usually the first notch, i.e., the notch closest to a handle portion of a key, is different in shape from the remaining notches. More particularly, a first notch can have a side which juts into the key at a 90° angle. This can provide a surface for abutting the lock upon full insertion of the key. The 90° side is joined to a straight segment of the notch. The other side of the first notch can have some other angle, such as a 45° angle directed toward the other notches. Generally, the remaining notches on a key have two side segments joined by a middle segment such that each side segment is angled away from the middle segment at approximately 45°.

The notch shape corresponds to the shape of the punch and die used. In a traditional key punch apparatus, like that described in U.S. Pat. No. 3,748,940, a punch and die sub-assembly must be replaced with one of a desired configuration for each desired notch shape. This is time consuming and troublesome.

Keys and locks are made with great precision and low tolerances so that only a key corresponding with a particular lock will open it. Therefore, a key punch apparatus must be capable of cutting notches from a key blank in a series of exact positions and depths. This is achieved by securing a key blank to a carrier means which holds the blank in operative relation to a punch and die assembly. The carrier is movable in two dimensions, to place the key blank relative to the punch and die for selectively cutting a notch (1) in an exact position along the length of the key; and (2) at a desired depth.

Because of the close tolerance requirements for locks and keys, a key punch apparatus must also be constructed with close tolerances, and it is necessary to adjust the locating means to compensate for cumulative manufacturing tolerances or to periodically compensate for wear. This is particularly important in the locating means which controls the bite.

A lock manufacturer can provide a coded sequence of numbers that equate to particular key notch positions and depths which will work for a particular lock. The carrier movement is controlled in two dimensions by indexed mechanisms calibrated for use in conjunction with such a code.

Because common keys have either five, six, seven, or eight notches, a different calibration for the related indexing means must accommodate the different spacing between consecutive notches. In a traditional key punch apparatus, the key blank is moved on the carrier by a lever means for changing the notch position in relation to the punch and die assembly. It is known to provide an indexing plate for engaging this lever in a series of positions corresponding to a desired key configuration. However, in a traditional key punch assembly, the different indexing plate must be provided for each desired notch position configuration, e.g., five notches, six notches, etc. Therefore, it is desirable to provide a lever indexing means which corresponds to more than one notch position configuration so that the time, trouble and extra components are eliminated.

A need, therefore, exists for an improved key punch apparatus which can selectively punch a notch of a first shape and a second shape without changing parts. A further need exists for an improved key punch apparatus having an improved means of adjustment. Additionally, a need exists for an improved key punch apparatus which can be used to selectively cut notches from a key in more than one notch spacing configuration without replacing parts.

SUMMARY OF THE INVENTION

The present invention provides an improved key punch apparatus. To this end, in an embodiment, a key punch apparatus is provided for removing material selectively from a key blank. The apparatus has a base. A punch and die sub-assembly is retained in the base. The sub-assembly is selectively rotatable about an axis between first and second punch positions. A carrier means in mounted on the apparatus for supporting the key blank thereon in operative relation with the sub-assembly. An actuating handle is operatively coupled to the punch apparatus to cause and axial cutting stoke of the punch to remove a notch of the material from the key blank.

In an embodiment, actuating the punch in the first punch position results in a notch having an associated first shape. Actuating the punch in the second punch position results in the notch having an associated second shape.

In an embodiment, the sub-assembly can rotate approximately 90°.

In an embodiment, the carrier means includes first and second datum surfaces disposed perpendicularly to one another. The carrier means also has a means for securing the blank in abutting engagement with the surfaces. The carrier means is positionable by a first locating means to locate the blank in a selected one of a series of predetermined positions.

In an embodiment, the first locating means includes two oppositely disposed circular end sections having a common axis and which are supported by the base for rotational movement therein. An extension projects from one end section. An adjustment ring is disposed around the extension. A shaft member is disposed between the two end sections. The shaft member has a central axis which is offset from the common axis so that rotation of the end sections causes eccentric rotation of the shaft member. An adjustment screw extends through the ring for securing the ring to the extension. A knob is secured to the ring. The shaft member is operably connected to the carrier means to cause the carrier means and the key blank thereon to be moveable in a direction parallel to the first datum surface.

In an embodiment, a second locating means is provided. The second locating means includes a lever pivotally moveable to drive said carrier means in a direction parallel to the second datum surface. Operation of the first and second locating means causes the carrier means to be positionable for locating the blank in a predetermined position. The second locating means includes first and second lever indexing means. The first lever indexing means is for selectively securing the lever in one of a first series of said predetermined positions associated with a first quantity of spaced key blank notches. The second lever indexing means is for selectively securing the lever in one of a second series of predetermined positions associated with a second quantity of spaced key blank notches.

In an embodiment, the first and second lever indexing means include a positioning pin extending from the lever and plurality of spaced holes for receiving the positioning pin. A first set of labels are provided corresponding to the first quantity. A second set of labels are provided corresponding to the second quantity.

It is, therefore, an advantage of the present invention to provide a key punch assembly which can cut notches of material from a key blank of a first shape and a second shape without replacing parts.

A further advantage of the present invention is to provide a key punch apparatus which has an improved adjustment means.

Another advantage of the present invention is to provide a key punch apparatus which has two differently calibrated lever indexing means for cutting notches from keys having a configuration of either a first number of notches or a second number of notches.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
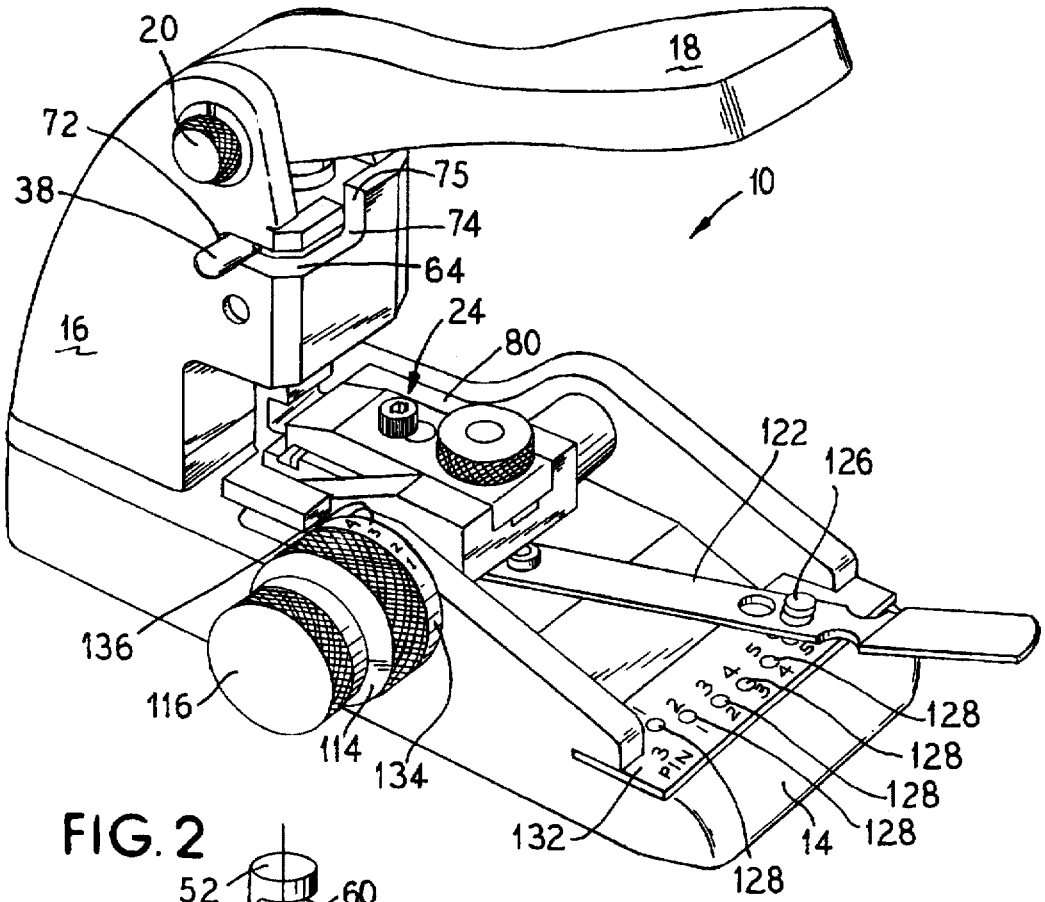
FIG. 1 illustrates a perspective view of a key punch apparatus embodying the improvements of the present invention.

In accordance with the invention described with reference to the accompanying figures wherein like numerals designate like parts, a key punch apparatus 10 is provided as shown in FIG. 1. Generally, the apparatus 10 has a boot-like base 12 which includes a toe section 14, and a heel section 16. An actuating handle 18 is pivotally supported on a pin 20 in the heel section 16. Downward manipulation of the actuating handle 18 moves a punch 22 (see FIGS. 2 and 3) on its cutting stroke.

A blank carrier 24 is slidably mounted on the base 12. A key blank 26 (see FIG. 5) can be supported on the blank carrier 24 to be located in a selected one of a series of predetermined positions relative to the punch 22. The punch 22 cuts notches of material from the key blank 26 to produce a desired key 26 (see FIGS. 4 and 5).

Figure 2:
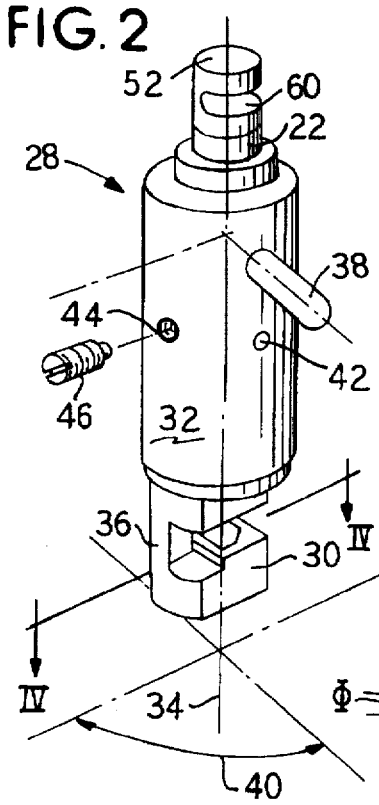
FIG. 2 illustrates a rotatable punch and die sub-assembly of the present invention.

Turning to FIG. 2, a punch and die sub-assembly 28 is illustrated which is comprised of the punch 22, an associated die 30, and a generally tubular punch housing 32. The punch housing 32 is elongated and has a punch axis 34. The punch 22 is slidably disposed within the punch housing 32 and can reciprocally move along the punch axis 34. The bottom of the punch housing 32 is integrally connected to the die 30 via a post member 36.

A rotation lever 38 is secured to the punch housing 32 and extends generally perpendicularly therefrom. The sub-assembly 28 is rotatably mounted in the base 12 so that the sub-assembly 28 can rotate about the punch axis 34 as indicated by the arrow 40 between a first punch position and a second punch position. FIG. 2 illustrates the subassembly aligned in the second punch position.

The punch housing 32 has a first indentation 42 and a second indentation 44 for engaging a ball plunger 46 which is mounted adjacently in the base 12. The first and second indentations 42, 44 are preferably separated by approximately 90°. The ball plunger 46 is spring biased against the subassembly 28 to positively locate the sub-assembly 28 at either the first punch position or second punch position.

Figure 3:
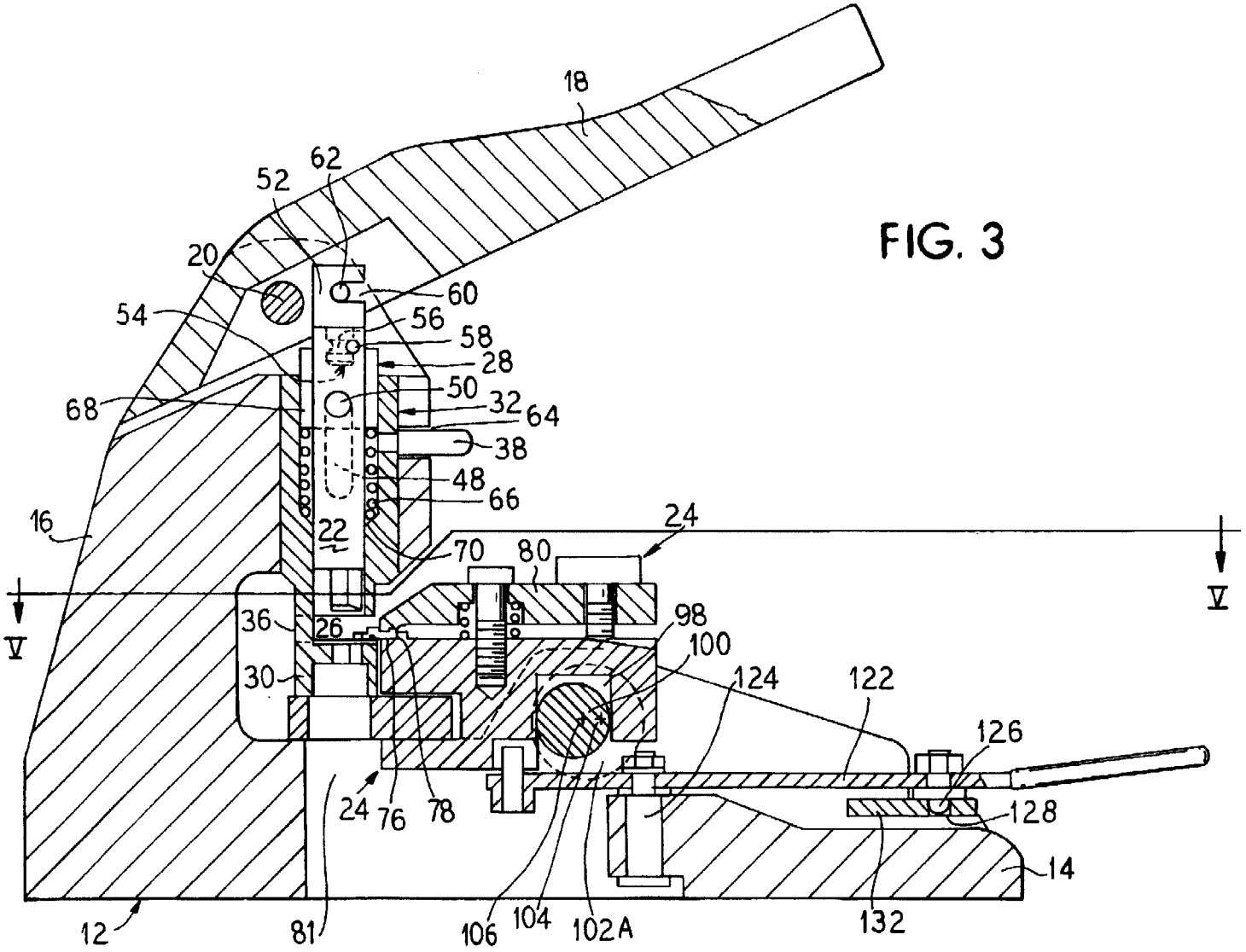
FIG. 3 illustrates a side cross-sectional view of a key punch apparatus according to the present invention, taken generally along line III—III of FIG. 6.

As illustrated in FIG. 3, the sub-assembly 28 is rotatably mounted in the apparatus 10. The tubular punch housing 32 is closely received in the heel section 16 of the base 12. However, the fit between the housing 32 and the base 12 is not so tight as to prevent rotation of the subassembly 28 within the base 12.

The punch 22 has an axially aligned elongated slot 48. A pin 50 secured to the punch housing 32 extends through the slot 48 so that the punch 22 stays aligned with the punch housing 32.

The punch 22 also has a pivotal head 52 mounted at a top end of the punch 22. The pivotal head 52 has a projection 54 which extends downward into the punch 22. The projection 54 has an annular groove 56 which tangentially engages a dowel pin 58, securing the pivotal head 52 to the punch 22. The dowel pin 58 is secured to the punch 22 and extends therethrough. The pivotal head 52 can rotate relative to the punch 22, but is secured to the punch 22 in the direction of the punch axis 34.

The pivotal head 52 has a generally horizontal slot 60 which engages a rod 62 secured to the actuating handle 18. Thus, the head 52 is retained generally in alignment with the actuating handle 18 and provides a linkage for moving the punch 22 along the punch axis 34 by a pivotal motion of the actuating handle 18. The rotation lever 38 extends through a slot 64 in the base 12 so that the rotation lever 38 can be gripped by a user.

A spring 66 is provided within the subassembly 28 between an annular sleeve 68 around the punch 22 and an annular shelf 70 within the housing 32. The spring 66 compresses on a cutting stroke of the punch 22, and biases the punch 22 and actuating handle 18 to a normal position, as illustrated in FIG. 3, when the actuating handle 18 is released.

A user can rotate the sub-assembly 28 relative to the base 12 by moving the rotation lever 38 within the slot 64. When the rotation lever 38 is against a first end 72 of the slot 64, the subassembly 28 is in the first punch position, and the ball plunger 46 is engaged in the associated first indentation 42. When the rotation lever 38 is against a second end 74 of the slot 64, the subassembly 28 is in the second punch position and the ball plunger 46 is engaged in the associated second indentation 44. Preferably, the angle between the first punch position and second punch position is 90°. The slot 64 has an opening 75 through which the rotation lever 38 can be lifted for removal of the subassembly 28 from the base 12. This provides a simple means for replacing the subassembly 28 after prolonged wear.

Also illustrated in FIG. 3, is the key blank 26 secured on the blank carrier 24 so that a desired portion of the key blank 26 is positioned between the punch 22 and die 30. The blank carrier 24 has a first datum surface 76 and a second datum surface 78 against which the key blank 26 can be precisely aligned relative to the carrier 24. The first datum surface 76 is preferably horizontally planar. The second datum surface 78 extends perpendicularly upward from the first datum surface 76. The blank carrier 24 has a clamp 80 which is used to secure a key blank against the first and second datum surfaces 76 and 78.

The blank carrier 24 is moveable in two dimensions to selectively position a key blank 26 relative to the punch 22. A first locating means moves the blank carrier 24 to control the bite of a notch to be cut. In other words, the first locating means moves the blank carrier parallel to the first datum surface 76, along a horizontal line between the toe section 14 and the heel section 16. A second locating means linearly moves the blank carrier 24 horizontally, in a direction parallel to the second datum surface 78 perpendicularly to the motion of the first locating means. The second locating means places the key blank 26 so that a notch can be cut at a desired position along the length of the key blank 26.

When a user moves the actuating handle 18 downward, the punch 22 slides downward along the axis 34 into the die 30, cutting a notch from the key blank 26 in the shape of the overlapping punch portion. The material removed from the notch falls downward through an aperture in the base 12.

In the present invention, the sub-assembly 28 is rotatable so that different shapes can be cut from the key blank 24. By rotating the sub-assembly 28, a different portion of the punch 22 is caused to overlap the key blank 26, resulting in a different shaped notch geometry.

Figure 4B:
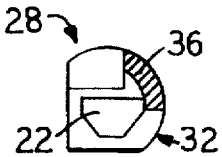
FIG. 4B illustrates the cross-sectional view of FIG. 4A rotated 90°.
Figure 4A:
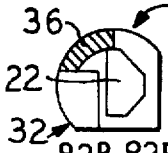
FIG. 4A illustrates a cross-sectional view of the punch and die subassembly taken generally from line IV—IV of FIG. 2.

Turning to FIGS. 4A–E, the shape of the punch 22 is shown in relation to particular notch shapes resulting from the selective rotational position of the subassembly. As illustrated in FIGS. 4A and 4B, the punch 22 preferably has a cross-sectional profile or shape which could be described as one-half of an octagon. In other words, the cross-sectional shape is six-sided, having two adjacent 90° corners and four 45° corners.

Figure 4C:
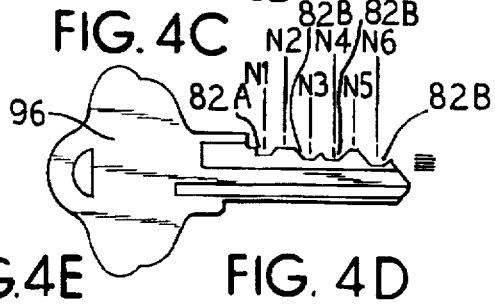
FIG. 4C illustrates a key having notches cut with the apparatus of the present invention.
Figure 4E:
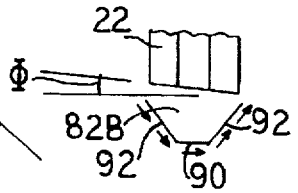
FIG. 4E illustrates a second shape of a notch cut by an apparatus of the present invention.
Figure 4D:
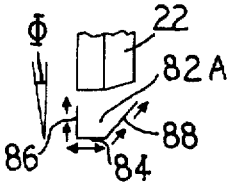
FIG. 4D illustrates a first shape of a notch cut by an apparatus of the present invention.

FIG. 4A illustrates the sub-assembly 28 in the first punch position. A portion of the punch periphery forms a first cutting edge which overlaps the key blank 26 to cut a notch 82A, as shown in FIGS. 4C and 4D. The first notch 82A thus has a first profile or shape corresponding to the first cutting edge. The cut at position N1 is usually referred to as the cut #1, as labeled in FIG. 4D.

FIG. 4B illustrates the sub-assembly 28 rotated to the second punch position, which is preferably 90° from the first punch position. When the subassembly 28 is in the second position, another portion of the punch periphery forming a second cutting edge overlaps the key blank 26. When actuated in this second position, the punch 22 cuts a notch 82B having a profile corresponding to the second cutting edge. Such a notch profile is typically punched at each of the remaining notch positions. The cuts at the remaining notch positions are be referred to as cuts #2–6, respective to those notch positions, as indicated in FIG. 4E. There could be more or fewer notches depending on the configuration and length of the desired key.

The first shape of notch 82A and the second shape of notch 82B are preferably trapezoidal. The first shape, illustrated in FIG. 4D, has a middle segment 84, a first side segment 86 disposed at approximately 90° to the middle segment 84, and a second side segment 86 angled away from the middle segment 84 at approximately 45°. The second shape illustrated in FIG. 4E, is defined by a middle segment 90 and two side segments 92 each angled away from the middle segment at approximately 45° so that the second shape is preferably symmetrical.

While the angle between the first punch position and the second punch position is preferably 90°, as shown in FIGS. 4A and 4B, respectively, the desired ability to cut multiple shapes with the same punch 22 could be achieved by configuring the punch to cut other shapes, such as a V-shaped notch or a rectangular notch. Furthermore, in an embodiment, the first and second punch positions could be separated by some other angle, e.g., 180°.

As illustrated in FIGS. 4D and 4E, the punch 22 has a tip with an angle Φ of approximately 5° from horizontal so that during a cutting stroke, the punch 22 engages the key blank 26 in a tapered manner to cause a shearing action. The direction of the shearing action is indicated by the arrows in FIGS. 4D and 4E, to form a notch having the first shape (FIG. 4D) or the second shape (FIG. 4E).

The key 26 illustrated in FIG. 4C has six notch positions, N1, N2, N3, N4, N5, and N6, although the apparatus could be used to cut a key having another number of notch positions. For example, the apparatus 10 illustrated in FIG. 5 is configured to cut in either five or six notch positions.

Referring back to FIG. 4C, the first notch position N1 is that closest to a handle portion 96 of the key 26. The first notch position N1 has a notch 82A which preferably has the first shape. The notches in the remaining notch positions N2–N6 preferably have the second shape (notches 82B). As illustrated by FIG. 4C, there might be no notch at a particular notch position, such as notch positions N2 and N5, depending on the particular key being cut.

The present invention also provides a means for adjusting the first locating means. As illustrated in FIG. 3, the lower surface of the blank carrier 24 opposite the clamp 80 has an elongated channel 98. The channel 98 is configured to closely receive a shaft 100 which is eccentrically rotatable to cause linear movement of the carrier 24 in a direction parallel to the first datum surface 76.

Figure 5:
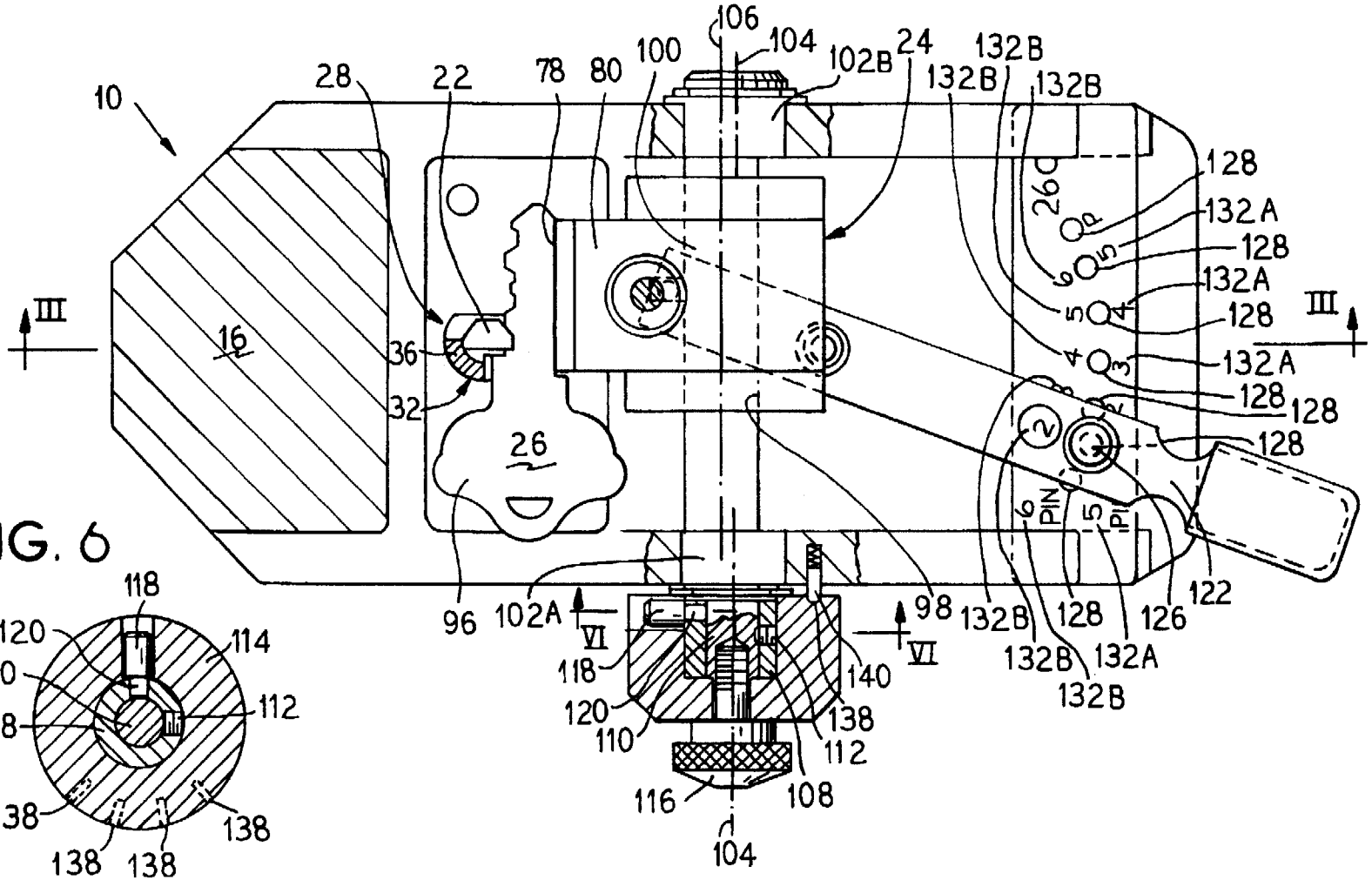
FIG. 5 illustrates a top cross-sectional view of a key punch apparatus taken generally along line V—V of FIG. 3 and having portions broken away.

As illustrated in FIG. 5, the first locating means has two circular, cylindrical end sections 102A, 102B which are aligned on a common axis 104. The shaft 100 is secured between the two end sections 102A, 102B so that a central axis 106 of the shaft 100 is parallel but offset from the common axis 104.

Figure 6:
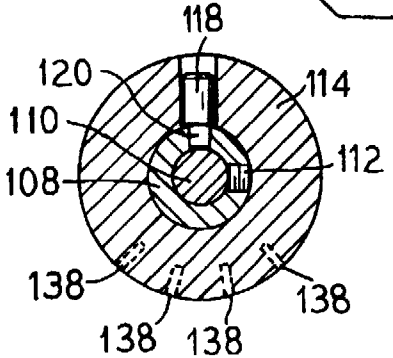
FIG. 6 illustrates a cross-sectional view taken generally along line VI—VI of FIG. 5.

As shown in FIGS. 5 and 6, an annular adjustment ring 108 is disposed around an axial extension 110 of the end section 102A. A set screw 112 is threaded through the adjustment ring 108 for securing the adjustment ring 108 to its extension 110. The set screw 112 can be loosened so that the adjustment ring 108 can be rotated about the extension 110. The set screw 112 can then be tightened to secure the ring 108 in a desired position relative to the extension 110.

A knob 114 is secured to the adjustment ring 108 as illustrated in FIGS. 5 and 6. The knob 114 generally surrounds the ring 108 and is secured to the extension 110 by a threaded fastener 116. The knob 114 is rotationally positioned and secured to the ring 108 by a locating pin 118 which is inserted into a bore in the knob 114 so that the pin 118 extends into the ring 108. The locating pin 118 has a stepped shape with a smaller diameter portion 120 that extends into a hole in the ring 108.

Turning the knob 114 causes eccentric rotation of the shaft 100 which is disposed in the channel 98, resulting in linear motion of the carrier 24 perpendicularly to the second datum surface 78 to selectively control the bite of a notch 82A, 82B to be cut from a key blank 26. By rotationally adjusting the ring 108 relative to the extension 110, the bite can be adjusted to compensate for wear and for manufacturing tolerances.

Also illustrated in FIG. 5 is the second locating means for moving the carrier 24 to selectively position the key blank 26 to a particular notch position. The second locating means has an elongated lever 122 which pivots on the base 12 by a pin 124 at an intermediate point on the lever 122. The lever 122 is linked to the carrier 24 so that a pivoting of the lever 122 will cause a linear sliding motion of the carrier 24.

According to the present invention, first and second lever indexing means are provided for selectively positioning the carrier 24 at a particular notch position. Preferably, the lever indexing means include a include a pin 126 which can be retained in one of a plurality of indexing holes 128 disposed in a lever indexing plate 130. The lever indexing plate, holes 128, and pin 126 are preferably common to both the first and second lever indexing means. The lever 122 preferably biases the pin 126 downward into a selected hole 128. Preferably, the index holes 128 are provided in the lever indexing plate 130 for locating the carrier 24 at each notch position for either a five-notch key or six-notch key.

The first lever indexing means further includes first set of index labels 132A adjacent the holes 128 corresponding to the resulting notch position of the carrier 24 for cutting a five-notch key. The second lever indexing means includes a second set of index labels 132B adjacent the holes 128 corresponding to the resulting notch position of the carrier 24 for cutting a six-notch key. This allows a user to cut more than one key configuration without having to replace the indexing plate 130.

It should be recognized that greater or fewer index holes 128 could be provided, e.g., for a seven notch or eight notch key configuration. Also, some other engagement means could be provided other than the pin-in-hole arrangement described.

The knob 114 is preferably provided with an indexing plate 134 calibrated knob index positions 136 to indicate a predetermined bite depth and carrier position associated with a particular knob position. A plurality of recesses 138 are disposed in the knob 114, each of which compliments one of the index locations 136. A spring-biased pin 140 is mounted in the base to releasably engage one of said recesses 138 at a selected knob position.

Figure 7:
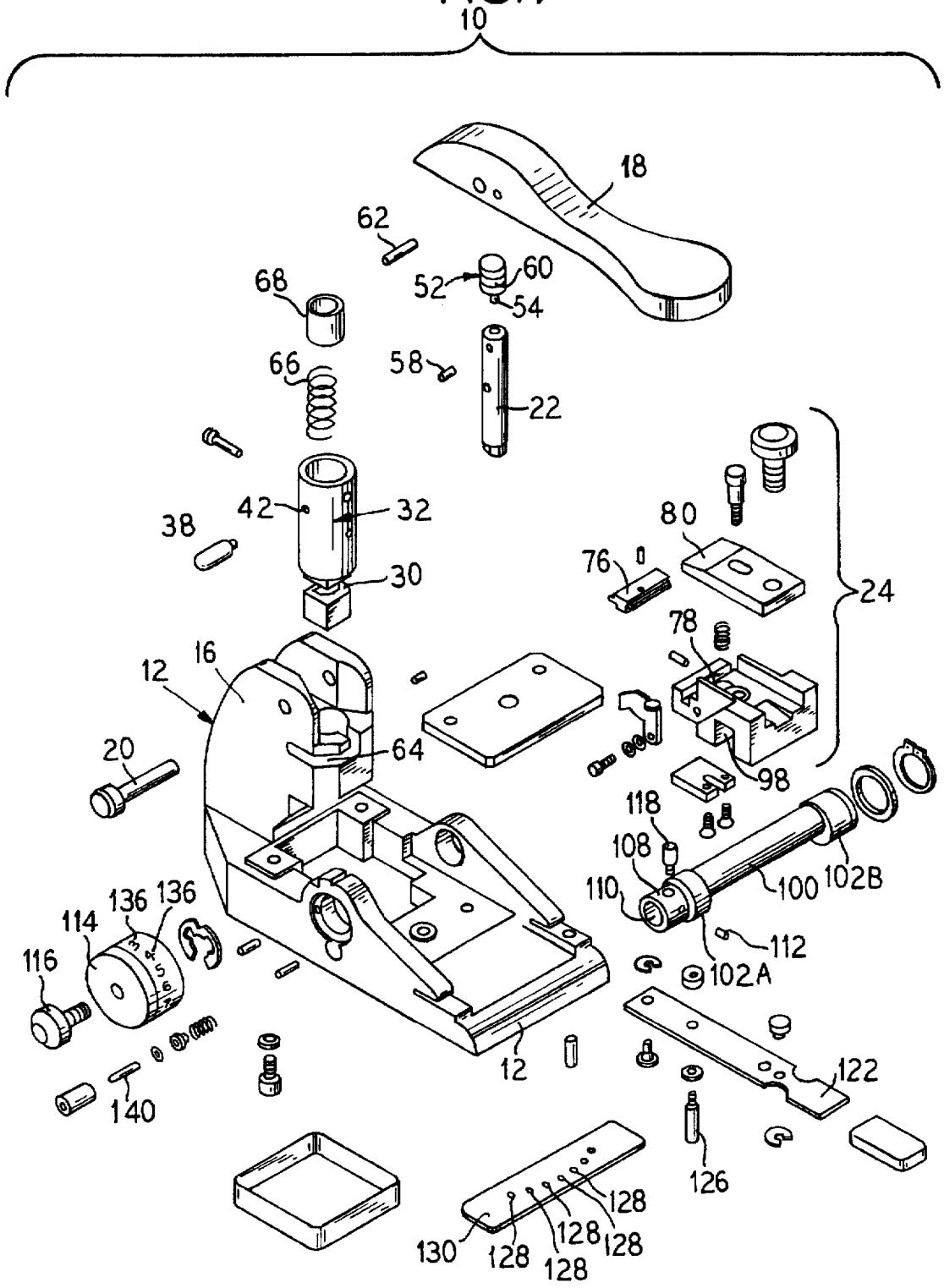
FIG. 7 illustrates an exploded perspective view of the key punch apparatus.

FIG. 7 is an exploded view which illustrates the individual disassembled components of the key punch apparatus described.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A key punch apparatus for removing material selectively from a key blank, said apparatus comprising:

a base;

an actuating handle operatively coupled to said punch such that manipulation of said handle moves said punch along said axis on a cutting stroke to remove said material from said key blank; and a carrier means mounted on said apparatus for supporting said key blank thereon in operative relation to said punch, said carrier means having first and second datum surfaces disposed perpendicularly to one another, and means for fixedly securing said blank in abutting engagement with said surfaces, said carrier means being positionable by a first locating means to locate said blank in a selected one of a series of predetermined positions;

said first locating means comprising:

two circular oppositely disposed end sections having a common axis, said end sections being supported by said base for rotational movement therein;

an extension of one said end section on said common axis;

a ring concentrically disposed around said extension;

an adjustment screw extending radially through said ring and positioned to engage said extension to rotationally secure said ring to said extension;

a knob concentrically disposed around an outer side of said ring;

a locating pin extending radially through said knob and said ring to rotationally secure said knob to said ring; and a shaft member disposed between said two end sections, said shaft member having a central axis which is offset from said common axis so that rotation of said end sections causes eccentric rotation of said shaft member;

said shaft member being operably connected to said carrier means to cause said carrier means and said key blank thereon to be movable in a direction parallel to said first datum surface.

2. The apparatus of claim 1, wherein said knob includes:

an indexing plate having a plurality of index location; and a series of recesses in said knob to complement said index locations;

wherein each recess and complementary location define one of said series of predetermined positions of said carrier means.

3. The apparatus of claim 2 further including spring biased retaining means on said apparatus for selectively and releasably engaging one of said recesses to retain said shaft member in position.

4. The apparatus of claim 1, wherein said carrier means is provided with a slot so constructed as to closely receive said shaft member, said eccentric rotation of said shaft member causing said carrier means to be moved along a path parallel to said first datum surface.

5. An apparatus according to claim 1 wherein said sub-assembly is rotatable about an axis between a first punch position and a second punch position.

6. An apparatus according to claim 1 further comprising a second locating means including a lever pivotally movable to drive said carrier means in a direction parallel to said second datum surface whereby operation of said first and second locating means cause said carrier means to be positionable for locating said blank in a selected one of said series of predetermined positions.

* * * * *